US007865981B2

(12) United States Patent
Harrow

(10) Patent No.: US 7,865,981 B2
(45) Date of Patent: Jan. 11, 2011

(54) BED BASE ASSEMBLED WITHOUT USING TOOLS OR SEPARATE FASTENERS AND METHOD

(76) Inventor: Lawrence Harrow, 5959 Corvette St., Commerce, CA (US) 90040

( * ) Notice: Subject to any disclaimer, the term of this patent is extended or adjusted under 35 U.S.C. 154(b) by 103 days.

(21) Appl. No.: 12/351,351

(22) Filed: Jan. 9, 2009

(65) Prior Publication Data

US 2010/0175186 A1 Jul. 15, 2010

(51) Int. Cl.
*A47C 19/00* (2006.01)

(52) U.S. Cl. ..... 5/400; 5/200.1; 5/282.1; 5/201

(58) Field of Classification Search ..... 5/400, 5/200.1, 201, 131, 282.1, 285, 286, 288, 5/292, 299, 304
See application file for complete search history.

(56) References Cited

U.S. PATENT DOCUMENTS

| | | | |
|---|---|---|---|
| 1,566,709 | A | 12/1925 | Wasserman |
| 1,915,215 | A | 6/1933 | Carpenter |
| 2,544,274 | A | 3/1951 | Moeller |
| 2,639,042 | A | 5/1953 | Lambert et al. |
| 2,721,338 | A | 10/1955 | Resnick |
| 3,123,837 | A | 3/1964 | Paine et al. |
| 3,605,142 | A | 9/1971 | Weinhart |
| 3,699,593 | A | 10/1972 | Oetiker |
| 3,713,181 | A | 1/1973 | Hougland |
| 3,730,108 | A | 5/1973 | Stroh |
| 3,744,068 | A | 7/1973 | Harris |
| 3,757,361 | A | 9/1973 | Harris et al. |
| 3,760,437 | A | 9/1973 | Hooker |
| 3,795,022 | A | 3/1974 | Harris |
| 3,803,644 | A | 4/1974 | Harris |
| 3,849,012 | A | 11/1974 | Krouse |
| 3,945,064 | A | 3/1976 | Harris et al. |
| 3,952,345 | A | 4/1976 | Spitz |
| 4,078,270 | A | 3/1978 | Nowell |
| RE29,611 | E | 4/1978 | Lawrence |
| 4,106,141 | A | 8/1978 | Hooker |

(Continued)

OTHER PUBLICATIONS

U.S. Appl. No. 11/326,817, filed Jan. 6, 2006, Harrow.

(Continued)

*Primary Examiner*—Robert G Santos
*Assistant Examiner*—Brittany M Wilson
(74) *Attorney, Agent, or Firm*—John J. Connors; Connors & Assoc.

(57) ABSTRACT

A bed base has parts adapted to be assembled together manually without the use of a tool or separate, non-integrated connectors. These parts include side members, corner connectors, and a cross-rail assembly. The side members are assembled into a rectangular support and attached at its corners by a male-female connection mechanisms in lower portions of the side members. The corner connectors overlap and lock together the upper portions of adjacent side members at the corners and are attached by male-female connection mechanisms. Each opposed side member includes a notch along an upper portion and the notches in the opposed side members are aligned upon assembly. The cross-rail assembly, which sits across the opposed side members within the notches, has an orthogonal leg member near each end. Each individual leg member projects through a corresponding notch and terminates in one component of two-component connector. The other component of each two-component connector is in the side member with the other component's corresponding notch.

15 Claims, 3 Drawing Sheets

U.S. PATENT DOCUMENTS

| | | | | | |
|---|---|---|---|---|---|
| 4,196,484 | A | * | 4/1980 | Harris | 5/201 |
| 4,224,704 | A | | 9/1980 | Nowell | |
| 4,225,265 | A | | 9/1980 | Hooker et al. | |
| 4,263,683 | A | | 4/1981 | Knoke | |
| 4,276,665 | A | | 7/1981 | Mis | |
| 4,295,234 | A | | 10/1981 | Whitehead | |
| 4,444,323 | A | | 4/1984 | Travis | |
| 4,536,904 | A | | 8/1985 | Whitehead | |
| 4,554,692 | A | | 11/1985 | Whitehead | |
| 4,870,711 | A | | 10/1989 | Felix | |
| 5,012,538 | A | * | 5/1991 | Timm | 5/200.1 |
| 5,161,268 | A | | 11/1992 | Harrow | |
| 5,920,930 | A | | 7/1999 | Harrow | |
| 6,415,465 | B1 | | 7/2002 | Harrow | |
| 6,810,540 | B2 | | 11/2004 | Harrow | |
| 6,865,758 | B2 | | 3/2005 | Harrow | |
| 6,925,666 | B2 | | 8/2005 | Harrow | |
| 7,155,762 | B2 | | 1/2007 | Harrow | |
| 7,631,375 | B2 | * | 12/2009 | Quintile | 5/200.1 |
| 2008/0222801 | A1 | | 9/2008 | Harrow | |
| 2008/0222802 | A1 | | 9/2008 | Harrow | |
| 2010/0031440 | A1 | * | 2/2010 | Harrow | 5/201 |

OTHER PUBLICATIONS

U.S. Appl. No. 12/189,699, filed Aug. 11, 2008, Harrow.

* cited by examiner

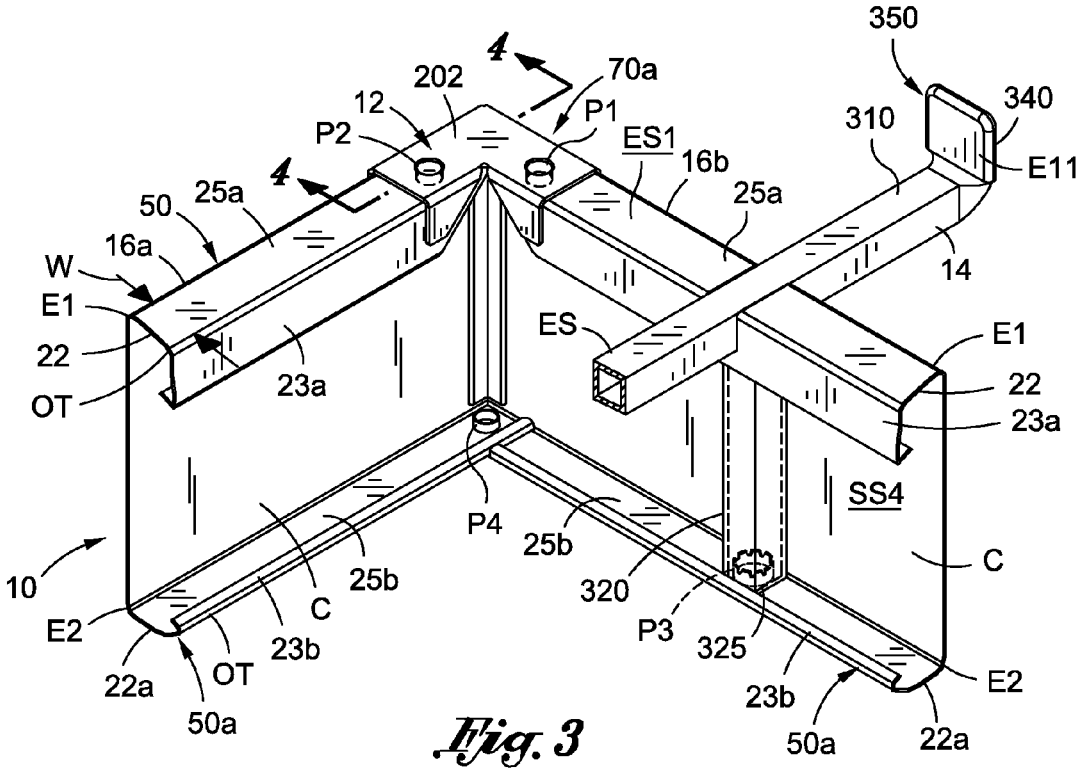
Fig. 3
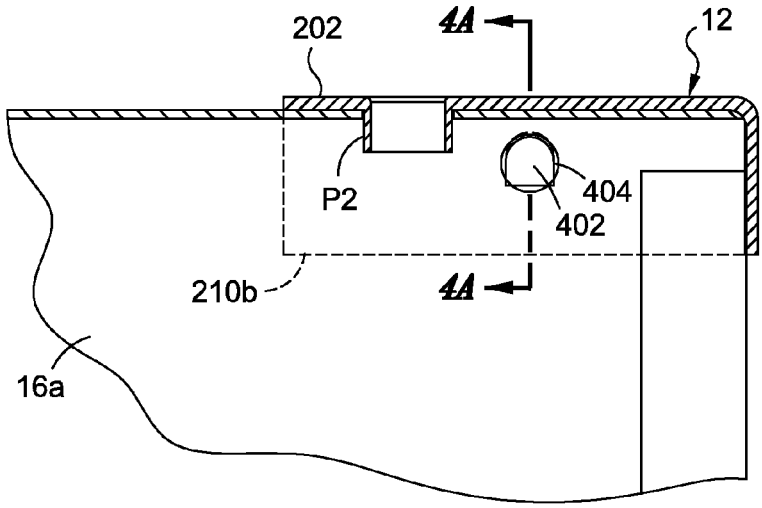
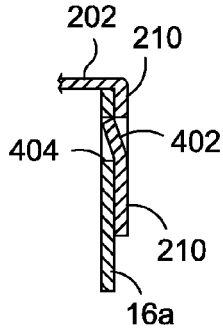
Fig. 4A
Fig. 4

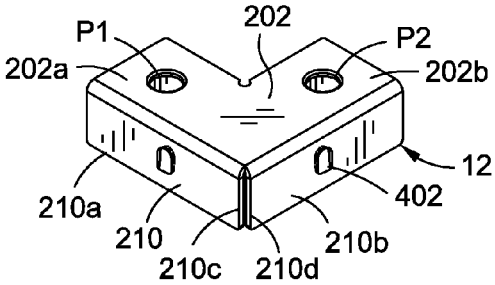
Fig. 5
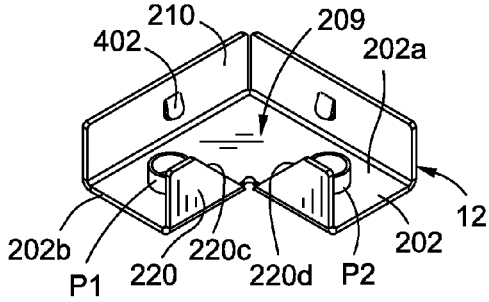
Fig. 6
Fig. 7A
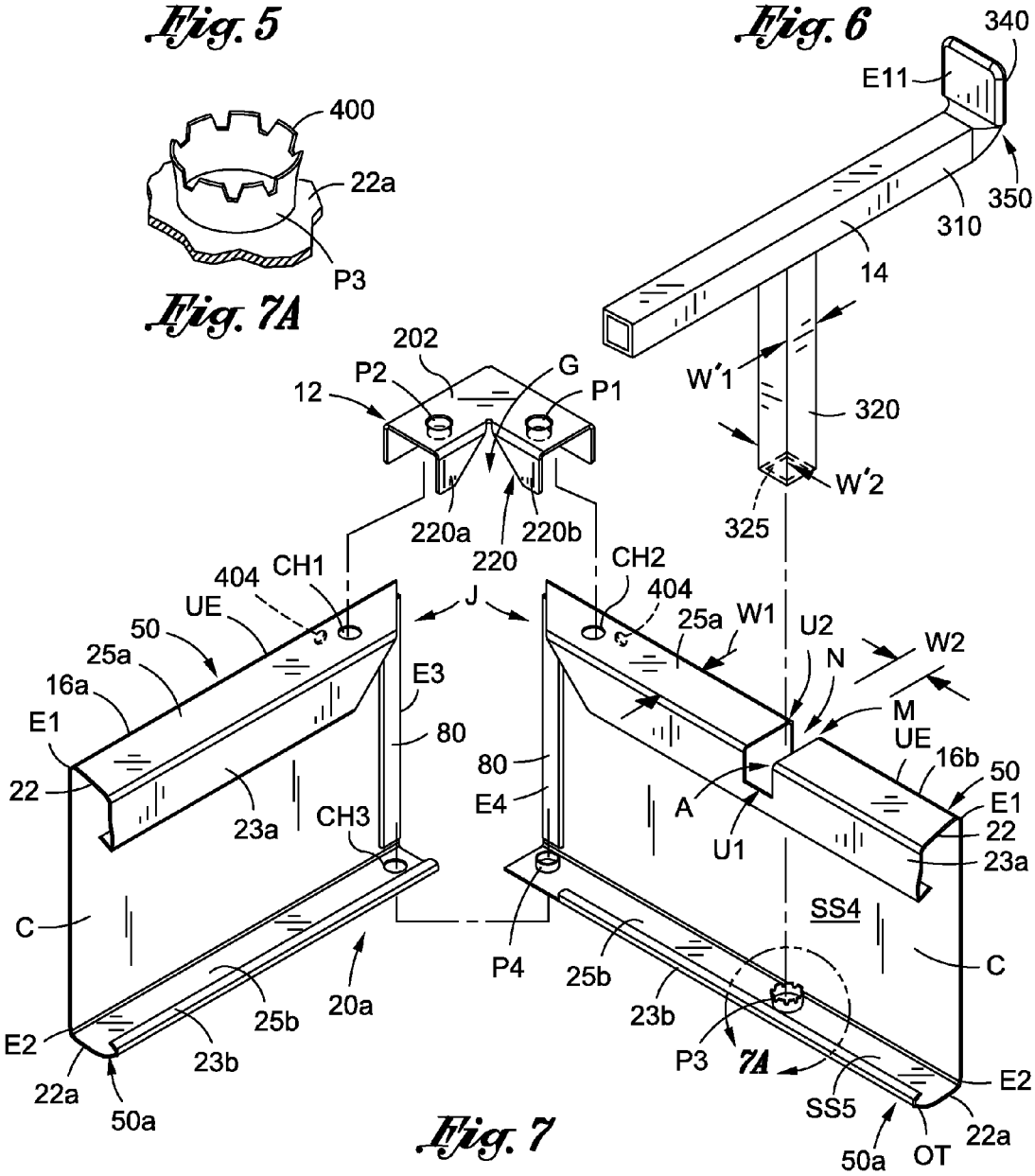
Fig. 7

BED BASE ASSEMBLED WITHOUT USING TOOLS OR SEPARATE FASTENERS AND METHOD

INCORPORATION BY REFERENCE

Any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The word "rectangular" includes square.

BACKGROUND

U.S. Pat. Nos. 6,865,758; 6,925,666; and 7,155,762 disclose bed bases made from sheet metal and include side members connected at corners. One or more cross-rails span the width of the bed base, adding rigidity and support for a box spring and mattress. In U.S. patent application Ser. No. 12/189,699, filed on Aug. 11, 2008 (herein Application), I disclose a bed base of simplified construction that reduces the cost of manufacture. Although an improvement in prior art bed bases, the bed base disclosed in the Application requires the use of a tool to assemble its parts. It and other bed bases also require using separate fasteners or connectors such as nuts or bolts that are tightened with a tool, and others may avoid using a tool but still require the use of a number of hand-tightened "wing" nuts or other non-integrated, separate fasteners.

This background discussion is not intended to be an admission of prior art.

SUMMARY

My bed base and method of assembling a bed base without the use of tools has one or more of the features depicted in the embodiment discussed in the section entitled "DETAILED DESCRIPTION OF ONE ILLUSTRATIVE EMBODIMENT." The claims that follow define my bed base and method of assembling a bed base without the use of tools, distinguishing them from the prior art. Without limiting the scope of my bed base and method as expressed by these claims in general terms, one or more, but not necessarily all, of their features are listed below not in any rank order; nor is this list intended to be exhaustive:

One, my bed base comprises parts adapted to be assembled together manually without the use of a tool and connection of the parts is achieved through connection means formed from and integral with the parts being assembled together. These parts include side members, corner connectors, and at least one a cross-rail assembly. Essentially all these parts may be formed from metal tubes and malleable metal sheet material and the connection means are stamped, bent, punched, or otherwise formed simultaneously as the individual parts are formed. In other words, the use of separate, individual fasteners or connectors is avoided.

Two, the side members are assembled into a rectangular support with a pair of side members opposed and adjacent side members forming corners of the rectangular support. The side members are substantially planar, and at least a sidewall of an individual side member is oriented vertically to enable upper exterior surface portions of the assembled side members to support a bed. There is an attachment member in a lower portion of each of the adjacent side members. These attachment members are configured and positioned to engage each other upon assembly of corresponding adjacent side members.

Three, the corner connectors are locked onto the adjacent side members at the corners. Each corner connector includes a pair of first linking elements. The adjacent side members each have a second linking element positioned so that, upon assembly, there is engagement between the first linking elements of individual corner connectors and the second linking elements of corresponding adjacent side members at individual corners. Each corner connector may have a plate member comprising a pair of arms substantially at a right angle to each other and in each arm includes one first linking element.

Four, the cross-rail assembly is connected to the opposed side members, and it has an elongated bar member and an orthogonal leg member extending therefrom and terminating in a first component of a two-component connector. Each opposed side member has a second component of the two-component connector. This second component is positioned so that, upon assembly, it engages the first component of the two-component connector of a corresponding aligned leg member.

Five, there is an upper planar support in each of the opposed side members having a guide structure for the bar member and the leg member. The guide structure includes an open notch. These open notches are configured and positioned so that, upon assembly, the notches in the opposed side members are aligned. When the cross-rail assembly is placed on the opposed side member, a portion of the bar member is seated in the aligned notches and each leg member extends through a corresponding notch and is positioned along an inside surface of a corresponding opposed side member. Each notch may be configured so an exterior surface of the elongated bar member is substantially flush with an exterior surface of the upper planar support member upon attaching the cross-rail assembly to the opposed side members.

Six, upon assembly, a locking mechanism at each corner engages to lock the corner connectors to the corners in a manner that prevents manual disassembly expect by use of a prying tool. In one embodiment, each corner connector may have a catch element and interlocks with an aperture in a side member. The catch element may be formed in a wall structure to project into a receptacle such as an aperture in an abutting wall structure of an adjacent part. The catch elements and apertures are at predetermined locations to attain an interlocking relationship when an individual corner connector is press fitted onto the upper portions of the adjacent side members.

Seven, the first and second linking elements may be configured to engage in a male and female mating relationship, the first and second components may be configured to engage in a male and female mating relationship, and the attachment members may be configured to engage in a male and female mating relationship.

My method of assembling a bed base without the use of tools comprises the steps of:

(a) providing the following bed base parts:

side members adapted to be assembled into a rectangular support including adjacent side members forming corners of the rectangular support, each of the adjacent side members including a first locking element, and a pair of opposed side members, each opposed side member including a guide structure along an upper portion, said guide structure in the opposed side members being aligned upon assembly, corner connectors adapted to be connected to upper portions of the adjacent side members at said corners of the rectangular support, each said corner connector including a second locking element, a cross-rail assembly adapted to be connected to the opposed side members, said cross-rail assembly having an elongated bar member and a leg member extending therefrom and terminating in a first component of a two-component connector, each opposed side member having a second component of the two-component connector positioned to engage upon assembly with said first component of the two-component connector of a corresponding aligned leg member, said adjacent side members each having a second linking element positioned so that, upon assembly at each individual corner, one first linking element of the pair in each individual corner connector engages a corresponding second linking element in one of the corresponding adjacent side members and the other of the pair engages the second linking element in the other of the corresponding adjacent side members, and an attachment member in a lower portion of each of the adjacent side members, said attachment members configured and positioned to engage with each other upon assembly, (b) assembling the side members into a rectangular configuration by connecting together the attachment members in the lower portions of the adjacent side members so that said attachment members engage and the notches in the guide structures of the opposed side members are aligned, (c) attaching the cross-rail assembly to the assembled opposed side members of step (b) by inserting the bar member into the aligned guide structures in the opposed side members and inserting the leg member through an individual guide structure to connect the corresponding two components of the individual two-component connectors, and (d) press fitting individual corner connectors onto the corners at the upper portions of adjacent corresponding side members to engage the first and second locking elements and attain an interlocking relationship between each individual corner connector and corresponding adjacent side members.

The steps (a) through (d) may be in the listed sequence or steps may be in a different order. For example, step (d) may precede step (c).

DESCRIPTION OF THE DRAWING

One embodiment of my bed base is discussed in detail in connection with the accompanying drawing, which is for illustrative purposes only. This drawing includes the following figures (Figs.), with like numerals indicating like parts:

FIG. 3 is an enlarged, fragmentary perspective view showing adjacent side members connected at ends thereof.

FIG. 4 is a cross-sectional view taken along line 4-4 of FIG. 3.

FIG. 4A is a cross-sectional view taken along line 4A-4A of FIG. 4.

FIG. 5 is a perspective view of a corner connector used with my bed base showing its exterior surface.

FIG. 6 is a perspective view of the corner connector depicted in FIG. 5 showing its interior surface.

FIG. 7 is an exploded perspective view of the corner of my bed base shown in FIG. 3.

FIG. 7A is a fragmentary perspective view of one component of a two-component connector taken along line 7A of FIG. 7.

DETAILED DESCRIPTION OF ONE ILLUSTRATIVE EMBODIMENT

Figure 1:
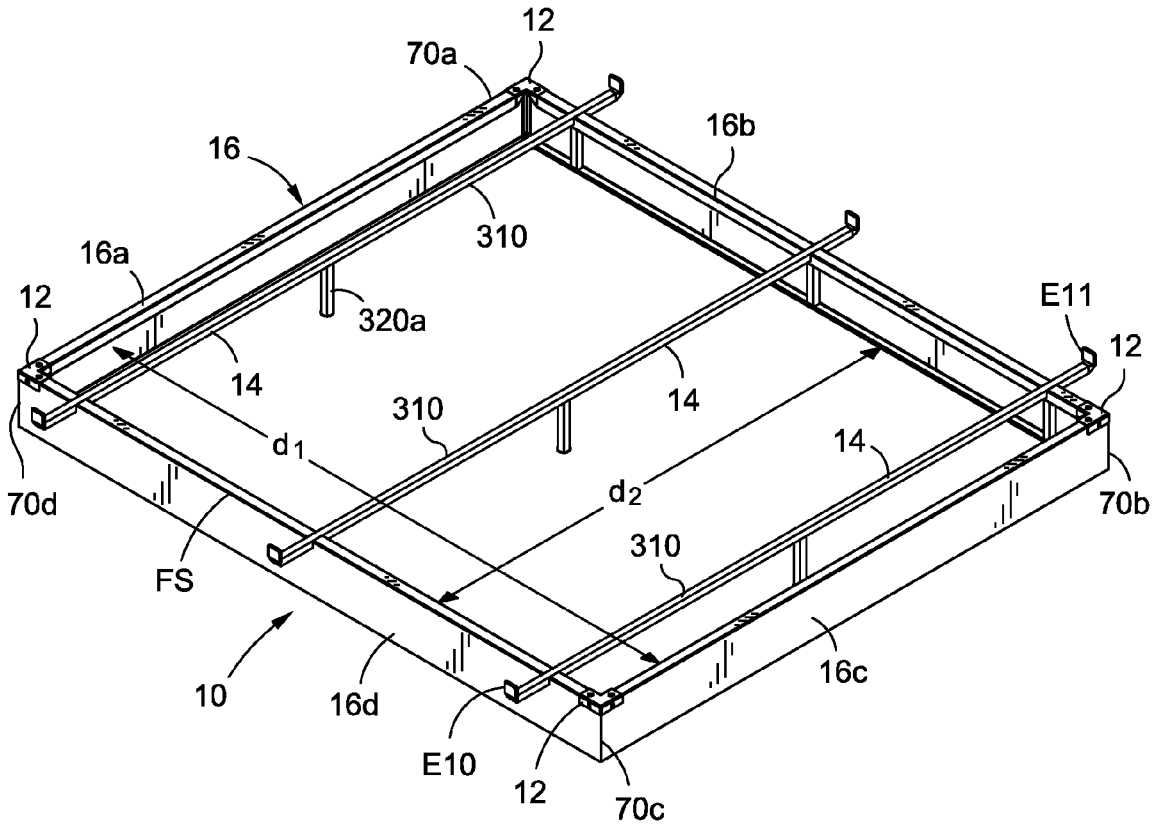
FIG. 1 is a perspective view of one embodiment of my bed base.
Figure 2:
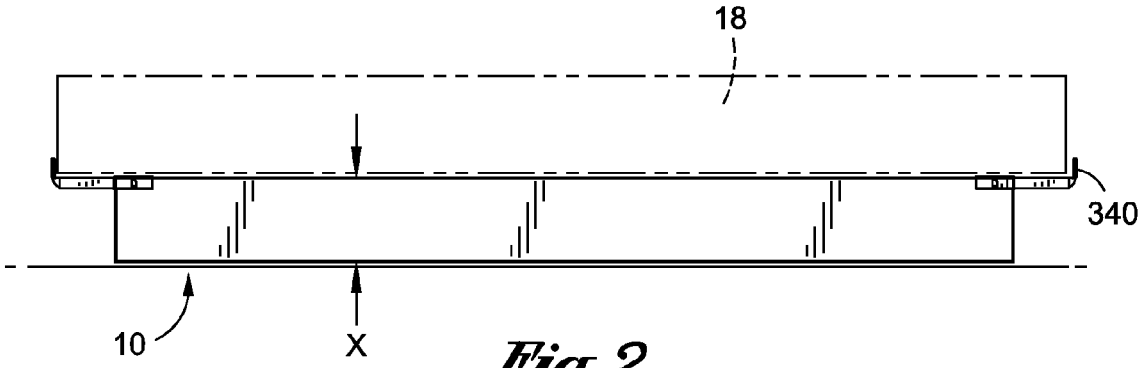
FIG. 2. is a side elevation view of the embodiment of my bed base shown in FIG. 1.

As illustrated in FIG. 1, my bed base 10 for a box-spring mattress 18 (shown in dotted lines in FIG. 2) comprises a limited number of parts adapted to be assembled together manually without the use of a tool. These parts include one or more cross-rail assembly 14, side members 16*a* through 16*d*, and corner connectors 12. The side members 16*a*, 16*b*, 16*c*, 16*d* are designed so opposed pairs of side members 16*a* and 16*c*, and 16*b* and 16*d*, are essentially mirror images. The side members 16*a* through 16*d* are connected at lower portions to form a rectangular support assembly 16 and the cross-rail assemblies 14 are positioned across a pair of opposed side members and then the corner connectors 12 are locked to the corners. One pair of substantially parallel side members 16*a* and 16*c* are separated by a predetermined distance d1 and another pair of substantially parallel side members 16*b* and 16*d* are separated by a predetermined distance d2. Pairs of adjacent side members 16*a* and 16*b*, 16*b* and 16*c*, 16*c* and 16*d*, and 16*d* and 16*a* are connected by an individual corner connector 12 to form the respective corners 70*a*, 70*b*, 70*c*, and 70*d* of the rectangular support assembly 16. Three cross-rail assemblies 14 connect the opposed side members 16*b* and 16*d*. In general, the individual parts of my bed base 10 are mainly made from metal tubes and sheet metal and formed using conventional stamping, welding, and bending techniques. The illustrated bed base 10 is sized to support a standard box-spring mattress 18.

In FIG. 1 the one embodiment of my bed base 10 is shown fully assembled. Kits of the disassembled parts may be sold for different sizes, for example, twin, standard, queen, king and even custom size. The purchaser would assembly the parts provided in the kits to make my bed base.

Rectangular Support Assembly

The rectangular support assembly 16 includes the four generally rectangular side members 16*a*, 16*b*, 16*c*, and 16*d* that are typically first assembled by connecting attachment members in lower portions of adjacent side members. The individual side members 16*a*, 16*b*, 16*c*, 16*d*, are preferably made from roll formed sheet steel having a thickness of from about 16 to about 20 gauge. The sheet steel is bent into the desired configuration using conventional manufacturing equipment. The opposed side members 16*b* and 16*d* are of the same length of about 71 inches and they typically do not vary no matter what the size of the box-spring and mattress being supported. Depending on the size of the box-spring and mattress being supported, the opposed side members 16*a* and 16*c* have a length ranging from about 26 to about 63 inches. For any type of box-spring and mattress being supported, the opposed side members 16*a* and 16*c* are of the same length. For example, when a twin size box-spring and mattress is being supported, the length is 26 inches, when a full size box-spring and mattress is being supported, the length is 40 inches, when a king size box-spring and mattress is being supported, the length is 58 inches. All the side members 16*a*, 16*b*, 16*c*, and 16*d*, are of the same width x ranging from about 5 to about 18 inches.

As best shown on FIGS. 3 and 7, each individual side member 16*a*, 16*b*, 16*c*, and 16*d* has a generally C-shaped cross-sectional configuration comprising a central, longitudinally extending, planar portion C with opposed edges E1 and E2. The opposed ends E3 and E4 (FIG. 7) of each individual side member 16*a*, 16*b*, 16*c*, and 16*d* are mitered, that is, cut inward at an angle of substantially 45-degrees to enable the formation of a miter joint J between upper portions of the side members at each corner 70*a*, 70*b*, 70*c*, and 70*d* of the adjoining adjacent ends E3 and E4 of the adjacent side members 16*a* and 16*b*, 16*b* and 16*c*, 16*c* and 16*d*, 16*d* and 16*a*. To provide greater rigidity the opposed edges E3 and E4 each include an inwardly folded rectangular portion 80 formed from the planar portion C.

There extends outward in the same direction, respectively from each edge E1 and E2, an L-shaped shoulder support/stiffener 50 and 50*a*. The support stiffeners 50 and 50*a* face each other, with their feet 23*a* and 23*b* pointing at each other and their legs 25*a* and 25*b* oriented horizontally to form longitudinal, planar support members 22 and 22*a*. Each leg 25*a* or 25*b* is at a right angle to the planar portion C. The individual feet 23*a* and 23*b* extend from an outer tip OT of the leg 25*a* or 25*b*. Each longitudinal support member 22 and 22*a*, or leg 25*a* and 25*b* has substantially the same width W, typically from about ¾ to about 1¼ inches. The length of each individual leg 25*a* and 25*b* is usually the same as the length of the side member 16*a*, 16*b*, 16*c*, or 16*d* from which it extends.

In the individual side members 16*b* and 16*d* there are three cut out notches N (FIG. 7), located on the upper planar support member 22 of the L-shaped shoulder support/stiffener 50, spaced apart a distance which varies depending on the size of the box-spring and mattress being supported. Each individual pair of notches N is set back from the closest end E3 or E4, as the case may be, by an equal distance, typically from about 6 to 12 inches. As shown in FIG. 7, the notches N are open along the upper planar support member 22 and form a guide-way and surrounding support structure for an individual leg member 320 passing through an aperture A (FIG. 7) in the upper planar support members 22. Each notch N partially extends into the foot 23*a* as well as partially through the planar portion C of a side member to form the aperture A. This aperture A has essentially the same overall configuration and dimensions as the cross-section of the corresponding aligned leg member extending therethrough. For example, as illustrated in FIGS. 3 and 7, the rectangular cross-sectioned leg member 320 has one side with a width W2' (FIG. 7) equal to the width W2 of the aperture A and another side with a width W1' (FIG. 7) equal to the width W1 of the aperture A. When the leg member 320 is rectangular, the notches N each comprise a pair of substantially U-shaped shaped cut-a-way sections U1 and U2 of the same configuration and dimensions. The one cut-a-way section U1 is in the foot 23*a* and the other cut-a-way section U2 is in the planar portion C of a side member. The spaced apart open mouths M of the cut-a-way sections U1 and U2 form the aperture A. Upon assembly of my bed base 10, the notches N in the side member 16*b* are aligned with and in registration with the notches N in the side member 16*d*. Near the ends E3 and E4 of the individual side members 16*a*, 16*b*, 16*c*, and 16*d* there are cut out holes CH1 and CH2 (FIG. 7) punched through the upper planar support member 22. Each cut out hole CH1 and CH2 is interactive with one of a pair of cylindrical post linking elements P1 and P2 (FIG. 6) of a plate member 202 of the corner connector 12.

The attachment members may be in the form of an individual cylindrical post P4 (FIG. 3) and a corresponding individual cut out hole CH3 (FIG. 7) in adjacent side members forming a corner. An individual cylindrical post P4 is at each opposed end of a lower planar support member 22*a* in each opposed side members 16*b* and 16*d*, and an individual cut out hole CH3 is at each opposed end of a lower planar support member 22*a* in each opposed side members 16*a* and 16*c*. These posts P4 and holes CH3 are positioned to engage upon assembly of the side members 16*a* through 16*d*.

Cross-Rail and Side Member Assembly

As best illustrated in FIGS. 3 and 7, each cross-rail assembly 14 comprises an elongated bar member 310 and three leg members, opposed outer leg members 320 and an optional third leg member 320*a* (FIG. 1) centered approximately in the middle of the elongated bar member 310. The bar member 310 and leg members 320 and 320*a* may each have substantially rectangular cross-sectional configuration of the same dimensions. Each individual leg member of the pair of leg members 320 is located near the elongated bar member's 310 opposed ends E10 and E11. The leg members 320 and 320*a* all project in the same direction at a right angle to the elongated bar member 310. The leg members 320 and 320*a* are of substantially the same length and each leg member terminates at an open lower end 325. The elongated bar member 310 terminates at the opposed ends E10 and E11 in a stop element 340 (FIG. 3). The stop element 340 is shaped in the form of an L-shaped arm 350. The stop element 340 is separated by a distance greater than the predetermined distance between the opposed side members 16*b* and 16*d* to accommodate the box-spring mattress 18. The L-shaped arm 350 of the stop element 340 prevents the box-spring mattress 18 from sliding off the bed base 10.

The open lower end 325 of each leg member 320 is one component of a two-component connector. The other component of each two-component connector is a cylindrical post P3 along the planar support member 22*a* that is positioned to engage the open lower end 325 of a corresponding leg member upon assembly. As illustrated in FIG. 7A, each post P3 has a flared end 400 that fits snug within the open lower end 325 a corresponding leg member 320 upon assembly. As depicted in FIGS. 3 and 7, there are three posts P3 located on the lower planar support member 22*a* of the L-shaped shoulder support/stiffener 50*a*, spaced apart a distance which varies depending on the size of the box-spring and mattress being supported. In each side member 16*b* and 16*d*, the individual notches N and posts P3 are in vertical alignment with each other.

FIGS. 3 and 7 best illustrate the configuration and dimensional relationship between a notch N and an individual leg member 320 received within the notch. For example, an individual notch N in the side members 16*b* and 16*d* is sized and configured to receive both the elongated bar member 310 and an individual leg member 320. For example, with the elongated bar members 310 and the individual leg members 320 substantially rectangular and of substantially the same dimensions, the depth, breath, and shape of each notch N enables the elongated bar member 310 to fit snug within the notch N and horizontally oriented with an individual leg member 320 projecting through an upper planar support member 22 and extending downward to the post P3 in the lower planar support member 22*a*. This arrangement of parts and their configuration and dimensions, creates an exposed exterior surface ES of the elongated bar member 310 that is substantially flush with an exterior surface ES1 of the upper planar support member 22 located on the side members 16*b* and 16*d*, resulting in a flush surface FS (FIG. 1) supporting the box-spring mattress 18. This allows the box spring mattress 18 to lay flat on top of the planar support members 22 of the rectangular support assembly 16.

As illustrated in FIGS. 1, 3 and 7, when the cross-rail assembly 14 is placed at a right angle to the side members 16*b* and 16*d*, individual leg members 320 in each cross-rail assembly 14 pass through an individual notch N in the planar support member 22 and each open end 325 engages an individual corresponding post P3. The leg members 320, which are within the support assembly 16, are separated by a distance d2 that is substantially equal to the predetermined distance between internal surfaces of the opposed side members 16*b* and 16*d*. Because of their length, rigidity, and position immediately adjacent the interior surface SS4 of the side members 16*b* and 16*d*, the leg members 320 provide support for the side members 16*b* and 16*d* so that, even through these side members are of thin sheet metal, they do not buckle. With the individual posts P3 aligned with individual notches N, the lower ends 325 of the leg members 320 are then next to an interior surface SS5 of the lower planar support member 22*a*.

Corner Connector

Only one corner connector 12 is used at each corner of my bed base 10 to securely connect and lock together the adjoining, adjacent ends of side members forming a corner. For example, as shown in FIGS. 3 and 7, the ends E3 and E4 of the adjacent side members 16*a* and 16*b* are attached to form the corner 70*a*. The corner connector 12 includes the plate member 202 including a pair of arms 202*a* and 202*b* that form a right angle channel 209 (FIG. 6) between an outer right angle wall 210 and an inner right angle wall 220. The outer right angle wall 210 is opposed to and in registration with the inner right angle wall 220.

As best shown in FIGS. 5 and 6, the outer right angle wall 210 is divided into two sections 210*a* and 210*b* with adjacent ends 210*c* and 210*d* touching or almost touching. Upon assembly, the section 210*a* extends along an exterior surface of the planar portion C of the side member 16*b*, and the section 210*b* extends along an exterior surface of the planar portion C of the side member 16*a*. As best shown in FIG. 6, the plate 202 has an inner right angle wall 220 that is divided into two sections 220*a* and 220*b* (FIG. 7) with a gap G between adjacent ends 220*c* and 220*d*.

The posts P1 and P2 of each corner connector 12 are vertically aligned respectively with the cut out holes CH1 and CH2 in the adjacent side members, for example, side member 16*a* and 16*b* as depicted in FIGS. 3 and 7. The plate 202 is stamped to produce the cylindrical posts P1 and P2 that extend from an underside of the plate 202. The right angle, adjoining adjacent ends E3 and E4 of the side members 16*a* and 16*b* are connected by a single corner connector 12 as depicted in FIGS. 3 and 7. During assembly of the bed base 10, the plate 202 of each individual connector 12 is mounted on the upper edge UE of adjacent corresponding side members 16*a* and 16*b*, 16*b* and 16*c*, 16*c* and 16*d*, 16*d* and 16*a*, thus forming the individual corners 70*a* through 70*d* of the rectangular support assembly 16. The right angle channels 209 of the plate 202 receive therein the upper edge UE including the leg support members 25*a*. The plate 202 overlaps the upper edge UE of the corresponding adjacent side members, thus forming an individual corner and locking the parts together in a fully assembled bed base. The planar support members 22, having widths equal to the width of the channels 209, fit snug within the channel 209 of each individual connector.

In the embodiment disclosed and as illustrated best in FIGS. 4A, 5, and 6, each corner connector 12 includes a wall structure having a pair of catch elements 402 that project inward from an inside surface and interlock with individual receptacles or apertures 404 in each of the corresponding adjacent side members. The catch elements 402 and apertures 404 are at predetermined locations to attain an interlocking relationship when an individual corner connector 12 overlaps and is press fitted onto the upper portions of the corresponding adjacent side members. Since in this embodiment the parts are made of a malleable material such as steel sheet, the catch element 402 and apertures 404 are formed in this malleable material by partially punching the steel sheet. The corner connectors are attached without the use of tools and lock the side members of the support assembly 16 in a substantially rigid condition which is further strengthened when one or more the cross-rail assembly 14 is in place as shown in FIG. 1.

Connection and Locking Structure

The connection linkage and locking structure of my bed base 10 is designed to avoid the use of tools or separate fasteners. The connection linkage includes, for example, linking elements such as the posts P1 and P2 and the opening CH1 and CH2, the two components (the post P3 and the open leg member end 325) of a two-component connector, the attachment members such as the post P4 and a corresponding hole CH3 in the adjacent side members and the locking structure which may include the catch elements 402 in the corner connectors 12 and apertures 404 in adjacent side members. The connection linkage may be through a male-female connection mechanism. For example, the first and second linking elements may be configured to engage in a male and female mating relationship; the first and second components may be configured to engage in a male and female mating relationship; and the attachment members of adjacent lower planar support members may be configured to engage in a male and female mating relationship. For example, there is a first linking element in each arm of the plate member of each corner connector and a second linking element in each of the upper planar support members. The first and second linking elements may be positioned so that, upon assembly, the first linking elements and second linking elements engage upon attaching an individual corner connector at an individual corner. The leg members 320 may each terminate in a first component of the two-component connector and each lower planar support member may have a second component of the two-component connector. The second component is positioned to engage the first component in a corresponding aligned leg member upon assembly. In this embodiment, the first component is an open end 325 of the hollow interior of a corresponding leg member 320 and the second component is an inwardly projecting cylindrical post P3 with a flared tip 400 along the lower planar support member of the opposed side members. The flared tip 400 fits snug within the open end upon assembly.

There is an attachment member at or near an end in each lower planar support member 22*a* of the adjacent side members. The lower planar support members 22*a* of the adjacent side members are configured to overlap upon assembly so the attachment members in each end of corresponding adjacent lower planar support members engage upon assembly. One attachment member may be a cut out hole CH3 in an end of the lower planar support member 22*a* of one of the adjacent side members forming a corner and the other attachment member may be an inwardly projecting post P3 that fits snugly with a corresponding opening or hole CH3 in a corresponding adjacent side member.

The locking structure prevents manual disassembly of my bed base 10 and is designed to lock each individual corner connector 12 to corresponding adjacent side members forming a corner. This locking structure is engaged upon assembly of individual corner connectors 12 and corresponding adjacent side members. In other words, when an individual corner connector is attached to a corner, it cannot be detached except by using a tool.

Method of Assembly

To assemble the bed base 10, the installer first connects the side members 16*a* through 16*d* together by inserting the inward projecting cylindrical attachment member or post P4 into the circular opening attachment member or hole CH3 at each corner, orienting the side members vertically with the lower planar support members 22*a* resting horizontally on a floor and the upper planar support members 22 exposed to enable the box-spring mattress 18 to be placed thereon. Next, each cross-rail assembly 14 is attached by placing each bar member 310 of each cross-rail assembly 14 in the aligned notches N in the opposed side members 16*b* and 16*d*. Concurrently, each leg member 320 is pushed through a corresponding notch N and the components of the two-component connector are coupled together. In this embodiment, flared tip 400 of the cylindrical member or post P3 is forced into the open end 325 of a corresponding leg member 320.

Finally as shown in FIG. 3, and usually, but not necessarily, the last step in my method, the installer positions each corner connector 12 to overlap the upper portions of corresponding adjacent side members, inserting the upper portions of corresponding adjacent orthogonal side members into the channel 209 of each corner connector 12. As the installer presses the corner connector against these upper portions, each catch element 402 is first depressed as it initially bears against an exterior surface of the sidewalls of the respective corresponding side members. When opposite a corresponding aperture 404, the catch element 402 springs back into its original, decompressed condition, fitting snug in a corresponding aligned aperture. As shown in FIG. 4A, each catch element 402 snaps into locking engagement with a corresponding aperture 404 to lock each corner connector 12 in position. With all the corner connectors 12 locked in place at the corners respective corners 70*a*, 70*b*, 70*c*, and 70*d*, my bed base 10 is completely assembled with its parts locked together. This simplifies the assembly of the bed base 10, enabling the installer to assemble more rapidly all the side members 16*a* through 16*d* into the bed base 10 without the use of any tool or separate fasteners.

My bed base 10 does not use any separate connectors to fasten the parts together. Rather the means for connecting the parts together are formed from and integral therewith to provide linkage of parts upon assembly exclusively by such integrated connectors. This avoids using any tools to assemble the bed base parts and any separate, non-integrated fasteners or connectors to connect these parts.

SCOPE OF THE INVENTION

The above presents a description of the best mode I contemplate of carrying out my bed base, and of the manner and process of making and using it, in such full, clear, concise, and exact terms as to enable any person skilled in the art to which it pertains to make and use my bed base. My bed base is, however, susceptible to modifications and alternate constructions from the illustrative embodiment discussed above which are fully equivalent. Consequently, it is not the intention to limit my bed base to the particular embodiment disclosed. On the contrary, my intention is to cover all modifications and alternate constructions coming within the spirit and scope of my bed base as generally expressed by the following claims, which particularly point out and distinctly claim the subject matter of my invention:

The invention claimed is:

1. A bed base comprising parts assembled together manually without the use of a tool, said parts including a plurality of side members adapted to be connected together to form a rectangular support including adjacent side members forming corners of the rectangular support and a pair of opposed side members separated by a predetermined distance, said adjacent side members each having an inwardly extending upper planar support member and an inwardly extending lower planar support member, and said opposed side members each having an inwardly extending upper planar support member and an inwardly extending lower planar support member, a plurality of corner connectors, each corner connector adapted to be connected to corresponding adjacent side members at individual corners, and each said corner connector having a plate member comprising a pair of arms substantially at a right angle to each other and formed from and integral with each arm a first linking element, at least some of the corner connectors including a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members, a second linking element formed from and integral with each corresponding upper planar support member, said second linking elements positioned so that, upon assembly, the first linking elements and second linking elements engage upon attaching an individual corner connector at an individual corner, a cross-rail assembly adapted to be connected to the opposed side members, said cross-rail assembly having an elongated bar member with opposed ends and a pair of leg members separated by substantially said predetermined distance, one leg member at or near each opposed end of the bar member, and each leg member extending from the bar member in the same direction substantially at a right angle to the bar member and having substantially the same length and terminating in a first component of a two-component connector, each said lower planar support member having a second component of the two-component connector, said second component formed from and integral with a corresponding lower planar support member and positioned to engage the first component in a corresponding aligned leg member upon assembly, each said upper planar support of the opposed side members having a guide structure including an open notch, said notches configured and positioned so that, upon assembly, the notches in the opposed side members are aligned and a portion of the bar member is seated in the aligned notches and each leg member extends through a corresponding notch and is positioned along an inside surface of a corresponding opposed side member, and an attachment member at or near an end in each lower planar support member of the adjacent side members, said lower planar support members of the adjacent side members configured to overlap upon assembly so the attachment members in each end of corresponding adjacent lower planar support members engage upon assembly.

2. The bed base of claim 1 where said first second linking elements are configured to engage in a male and female mating relationship, said first and second components are configured to engage in a male and female mating relationship, and said attachment members of adjacent lower planar support members are configured to engage in a male and female mating relationship.

3. A bed base comprising parts assembled together manually without the use of a tool, said parts including a plurality of side members adapted to be connected together to form a rectangular support including adjacent side members forming corners of the rectangular support and a pair of opposed side members separated by a predetermined distance, said adjacent side members each having an inwardly extending upper planar support member and an inwardly extending lower planar support member, and said opposed side members each having an inwardly extending upper planar support member and an inwardly extending lower planar support member, a plurality of corner connectors, each corner connector adapted to be connected to corresponding adjacent side members at individual corners, and each said corner connector having a plate member comprising a pair of arms substantially at a right angle to each other and formed from and integral with each arm a first linking element, a second linking element formed from and integral with each corresponding upper planar support member, said second linking elements positioned so that, upon assembly, the first linking elements and second linking elements engage upon attaching an individual corner connector at an individual corner, a cross-rail assembly adapted to be connected to the opposed side members, said cross-rail assembly having an elongated bar member with opposed ends and a pair of leg members separated by substantially said predetermined distance, one leg member at or near each opposed end of the bar member, and each leg member extending from the bar member in the same direction substantially at a right angle to the bar member and having substantially the same length and terminating in a first component of a two-component connector, each said lower planar support member having a second component of the two-component connector, said second component formed from and integral with a corresponding lower planar support member and positioned to engage the first component in a corresponding aligned leg member upon assembly, each said upper planar support of the opposed side members having a guide structure including an open notch, said notches configured and positioned so that, upon assembly, the notches in the opposed side members are aligned and a portion of the bar member is seated in the aligned notches and each leg member extends through a corresponding notch and is positioned along an inside surface of a corresponding opposed side member, and an attachment member at or near an end in each lower planar support member of the adjacent side members, said lower planar support members of the adjacent side members configured to overlap upon assembly so the attachment members in each end of corresponding adjacent lower planar support members engage upon assembly, where the corner connector includes outer wall elements along outer edges of the plate member that are substantially at a right angle to each other and to the plate member and inner wall elements along inner edges of the plate member that are substantially at a right angle to each other and to the plate member, said inner and outer wall elements forming a substantially right angle channel in the corner connector, where the outer wall elements each include a catch element that projects inward and each of the corresponding adjacent side members includes an aperture, each said catch element and corresponding aperture being at predetermined locations to attain an interlocking relationship upon assembly when an individual corner connector is press fitted onto the corresponding adjacent side members at upper portions thereof, the corner connector includes outer wall elements along outer edges of the plate member that are substantially at a right angle to each other and to the plate member and inner wall elements along inner edges of the plate member that are substantially at a right angle to each other and to the plate member, said inner and outer wall elements forming a substantially right angle channel in the corner connector.

4. The bed base according to claim 3 where essentially all the parts are formed from metal tubes and malleable metal sheet material.

5. The bed base of claim 3 where each said notch is configured so an exterior surface of the elongated bar member is substantially flush with an exterior surface of the upper planar support member upon attaching the cross-rail assembly to the rectangular support.

6. The bed base of claim 3 where the bar member and leg members each have a substantially rectangular cross-sectional configuration and the notches have a substantially rectangular cross-sectional configuration of substantially the same dimensions as a corresponding leg member received therein.

7. The bed base of claim 3 where an inner edge of the upper planar support member terminates in an inwardly oriented foot element that is substantially at a right angle to the upper planar support member and an edge of the upper planar support member terminates at a sidewall of the side member, and each notch partially extends into the foot element and into the sidewall to form a gap with essentially the same overall configuration as the cross-section of the leg member seated therein upon assembly.

8. A bed base comprising parts assembled together manually without the use of a tool, said parts including side members adapted to be assembled into a rectangular support including adjacent side members forming corners of the rectangular support, each of the adjacent side members including a first locking element, and a pair of opposed side members, each opposed side member including a guide structure along an upper portion, said guide structure in the opposed side members being aligned upon assembly, corner connectors adapted to be connected to upper portions of the adjacent side members at said corners of the rectangular support, each said corner connector including a second locking element, at least some of the corner connectors including a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members, a cross-rail assembly adapted to be connected to the opposed side members, said cross-rail assembly having an elongated bar member and a leg member extending therefrom and terminating in a first component of a two-component connector, each opposed side member having a second component of the two-component connector positioned to engage upon assembly with said first component of the two-component connector of a corresponding aligned leg member, said adjacent side members each having a second linking element positioned so that, upon assembly at each individual corner, one first linking element of the pair in each individual corner connector engages a corresponding second linking element in one of the corresponding adjacent side members and the other of the pair engages the second linking element in the other of the corresponding adjacent side members, and an attachment member in a lower portion of each of the adjacent side members, said attachment members configured and positioned to engage with each other upon assembly.

9. A bed base comprising parts assembled together manually without the use of a tool, said parts including side members adapted to be assembled into a rectangular support including adjacent side members forming corners of the rectangular support and a pair of opposed side members, each opposed side member including a notch along an upper portion, said notches in the opposed side members being aligned upon assembly, corner connectors, each individual corner connector adapted to be connected to upper portions of corresponding adjacent side members at individual corners, each said corner connector including a pair of first linking elements, a cross-rail assembly adapted to be connected to the opposed side members, said cross-rail assembly having an elongated bar member and a leg member extending therefrom and terminating in a first component of a two-component connector, each opposed side member having a second component of the two-component connector positioned to engage upon assembly with said first component of the two-component connector of a corresponding aligned leg member, said adjacent side members each having a second linking element positioned so that, upon assembly at each individual corner, one first linking element of the pair in each individual corner connector engages a corresponding second linking element in one of the corresponding adjacent side members and the other of the pair engages the second linking element in the other of the corresponding adjacent side members, and an attachment member in a lower portion of each of the adjacent side members, said attachment members configured and positioned to engage and interlink with each other upon assembly, a locking mechanism at each corner that, upon assembly, engages to lock the corner connectors to the corners, where each corner connector includes a wall structure having a pair of catch elements that project inward and each of the adjacent side members includes an aperture, said catch elements and apertures being at predetermined locations to attain an interlocking relationship upon assembly when an individual corner connector is press fitted onto the upper portions of the adjacent side members.

10. The bed base of claim 9 where said first and second linking elements are configured to engage in a male and female mating relationship, said first and second components are configured to engage in a male and female mating relationship, and said attachment members of adjacent lower planar support members are configured to engage in a male and female mating relationship.

11. The bed base of claim 10 where the bar member and leg members each have a substantially rectangular cross-sectional configuration of substantially the same dimensions and the notches have a substantially rectangular cross-sectional configuration of substantially the same dimensions as the bar member and leg members.

12. A bed base comprising parts assembled together manually without the use of a tool, said parts including side members adapted to be assembled into a rectangular support with a pair of side members opposed and adjacent side members forming corners of the rectangular support, corner connectors adapted to be connected to the adjacent side members at said corners, each said corner connector including a pair of first linking elements, a cross-rail assembly adapted to be connected to the opposed side members, said cross-rail assembly having an elongated bar member and a leg member extending therefrom and terminating in first component of a two-component connector, each opposed side member having a second component of the two-component connector positioned to engage upon assembly said first component of the two-component connector of a corresponding aligned leg member, said adjacent side members each having a second linking element positioned so that, upon assembly, the first linking elements of individual corner connectors and the second linking elements of corresponding adjacent side member at individual corners engage, and an attachment member in a lower portion of each of the adjacent side members, said attachment members configured and positioned to engage each other upon assembly, said first and second linking elements being configured to engage in a male and female mating relationship, said first and second components being configured to engage in a male and female mating relationship, and said attachment members of adjacent lower planar support members being configured to engage in a male and female mating relationship, and where the corner connector includes a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members.

13. A bed base comprising planar side members formed from sheet metal and each having upper exterior surface portion, said planar side members assembled into a rectangular support and oriented vertically to enable the upper exterior surface portions to support a bed, said planar side members including adjacent side members forming corners of the rectangular support, each adjacent planar side member including therein an aperture, and a pair of opposed side members each including a notch along the upper exterior surface portion, said notches in the opposed side members being aligned, corner connectors overlapping the exterior surface portions of adjacent side members and locked thereto at said corners, each said corner connector including a substantially L-shaped top plate member having a pair of first linking elements, and attached to the plate member, a pair of substantially orthogonal wall elements, each wall element including a catch element that projects inward, said catch elements and apertures being at predetermined locations to attain an interlocking relationship as the corner connectors are attached to the corners without using a tool, at least some of the corner connectors including a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members, a cross-rail assembly connected to the opposed side members, said cross-rail assembly having an elongated bar member and a leg member extending therefrom and terminating in a first component of a two-component connector, each opposed side member having a second component of the two-component connector engaged with said first component of the two-component connector of a corresponding aligned leg member upon manual connection without the using a tool, an attachment member in a lower portion of each of the adjacent side members, said attachment members engaged with each other upon manual connection without using a tool, each said notch configured so the upper exterior surface portions of the side members are substantially flush with an exterior surface of the bar member of the cross-rail assembly.

14. A bed base comprising four side members, four corner connectors, and at least one cross-rail assembly, said side members assembled into a rectangular support and attached by a male-female connection mechanism at or nearby corners of the rectangular support at lower portions of the side members, a pair of the side members being opposed and each including a notch along an upper portion of a corresponding side member, the notches in the opposed side members being aligned upon assembly, said cross-rail assembly extending across the opposed side members and sitting within the aligned notches, said cross-rail assembly having an orthogonal leg member that projects through a notch in a corresponding side member and terminates in one component of a male-female connection mechanism, the other component of the male-female connection mechanism being in the corresponding side member, said corner connectors overlapping the upper portions of adjacent side members and being attached by a pair of male-female connection mechanisms at the corners to corresponding adjacent side members, at least some of the corner connectors including a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members.

15. A bed base comprising four side members, four corner connectors, and at least one cross-rail assembly, means formed from and integral with the side members for connecting said side members into an assembled rectangular support, said connecting means being at or nearby lower portions of the side members, a pair of the side members being opposed and each including a notch along an upper portion of a corresponding side member, the notches in the opposed side members being aligned upon assembly, said cross-rail assembly extending across the opposed side members and sitting within the aligned notches, said cross-rail assembly having an orthogonal leg member that projects through a notch in a corresponding side member, each said corresponding leg member and a corresponding side member having means formed from and integral with therewith for connecting said corresponding leg member and side member, said corner connectors overlapping the upper portions of each pair of adjacent side members and each said corner connector and corresponding pair of adjacent side members having means formed from and integral with therewith for connecting each said corner connector and corresponding pair of adjacent side members, at least some of the corner connectors including a wall structure having a pair of catch elements that project inward and each of the adjacent side members includes an aperture, said catch elements and apertures being at predetermined locations to attain an interlocking relationship upon assembly when the corner connector is press fitted onto the upper portions of the adjacent side members.

* * * * *